United States Patent [19]

Tange

[11] Patent Number: 4,963,944

[45] Date of Patent: Oct. 16, 1990

[54] RESIDUAL TONER CLEANING DEVICE FOR IMAGE FORMING APPARATUS

[75] Inventor: Keigo Tange, Osaka, Japan

[73] Assignee: Minolta Camera Kabushiki Kaisha, Osaka, Japan

[21] Appl. No.: 372,901

[22] Filed: Jun. 28, 1989

[30] Foreign Application Priority Data

Jun. 30, 1988 [JP] Japan ..... 63-164201

[51] Int. Cl.[5] ..... G03G 21/00

[52] U.S. Cl. ..... 355/298; 355/296

[58] Field of Search ..... 355/296, 298, 301; 15/256.5, 256.51

[56] References Cited

U.S. PATENT DOCUMENTS

| | | | |
|---|---|---|---|
| 3,654,654 | 4/1972 | Abreu et al. | 15/1.5 |
| 3,807,853 | 4/1974 | Hudson | 355/298 |
| 4,181,425 | 1/1980 | Higaya et al. | 355/296 |
| 4,739,370 | 4/1988 | Yoshida et al. | 355/296 |

FOREIGN PATENT DOCUMENTS

| | | |
|---|---|---|
| 56-7958 | 1/1981 | Japan . |
| 58-142367 | 8/1983 | Japan . |
| 61-91680 | 5/1986 | Japan . |

*Primary Examiner*—A. T. Grimley
*Assistant Examiner*—Sandra L. Hoffman
*Attorney, Agent, or Firm*—Willian Brinks Olds Hofer Gilson & Lione

[57] ABSTRACT

A residual toner cleaning device for removing the residual toner on a photosensitive drum of an image forming apparatus of the invention is provided with an elastic roller in contact with said photosensitive drum and rotatable to remove said residual toner from said photosensitive drum, regulating means encompassing at least a portion of said elastic roller and having a compressing portion which compresses said elastic roller and a releasing portion for releasing said elastic roller from the compression to release the residual toner carried by said elastic roller, and toner collecting means for collecting the toner released by said elastic roller. The elastic roller ejects the toner toward the toner collecting means by the restoring force of the elastic roller released from the compression by the compressing portion of the regulating means, and the toner collecting means collects the toner.

10 Claims, 4 Drawing Sheets

RESIDUAL TONER CLEANING DEVICE FOR IMAGE FORMING APPARATUS

BACKGROUND OF THE INVENTION

1. Field of the Invention

The present invention relates to a residual toner cleaning device for an image forming apparatus. wherein an elastic roller is in contact with a photosensitive drum in order to remove a residual toner on the photsensitive drum, and send the toner in a rotational direction of the elastic roller to be collected in a toner collecting portion.

2. Description of Related Art

FIG. 1 is a schematic sectional diagram showing a construction of a conventional residual toner cleaning device, as disclosed in Japanese Utility Model Laid-Open No. 56-7958 (1981). In the figure, a reference numeral 101 shows a photsensitive drum. A cleaning blade for removing the residual toner on the surface of the photosensitive drum 101 and the minute particles of the transfer paper stuck thereon with static electricity charge, is provided at a position where the edge thereof is in contact with the surface of the photsensitive drum. A screw conveyer 103 is provided for collecting the removed toner, the particles of paper and so on. Between the cleaning blade 102 and the screw conveyor 103 provided a carrying roller 104 for carrying the toner and the particles of the paper removed by the cleaning blade 102 toward the direction of the screw conveyor 103 by the rotation thereof, and a rotating brush 105 compellingly scraping away the toner and the particles of the paper adhering to the carrying roller 104, is provided at a position where the tips thereof are in contact with the carrying roller 104 and is driven to rotate in the same direction as the carrying roller 104.

Hereinafter follows and explanation of the operation of the residual toner cleaning apparatus with the above-described construction. The cleaning blade 102 scrapes away and removes the toner and the particles of the paper adhering to the surface of the photosensitive drum 101. The carrying roller 104 transfers the removed toner and the particles of the paper toward the screw conveyor 103. At that time, the rotating brush 105 is driven to rotate in the same direction as the carrying roller 104, thereby scraping away the toner and the particles of the paper adhering to the surface of the carrying roller 104 compulsorily.

As is understood from the above, since in the conventional residual toner cleaning device the cleaning blade 102 scrapes away the toner and the particles of the paper adhering to the surface of the photosensitive drum 101, it is possible that the surface of the photsensitive drum 101 is scratched. And since the cleaning device comprises the cleaning blade 102, the carrying roller 104, and the rotating brush 105, the number of the components is so many that the construction of the device is complicated.

SUMMARY OF THE INVENTION

The present invention has been devised to solve the problems above mentioned.

The first object of the invention is to provide a residual toner cleaning device having high ability in removing the residual toner.

The second object of the invention is to provide a residual toner cleaning device that does not scratch a surface of a photosensitive drum.

The third object of the invention is to provide a residual toner cleaning device of a simple construction having less number of components.

The above and further objects and features of the invention will more fully be apparent from the following detailed description with accompanying drawings.

DESCRIPTION OF THE PREFERRED EMBODIMENTS

Figure 1:
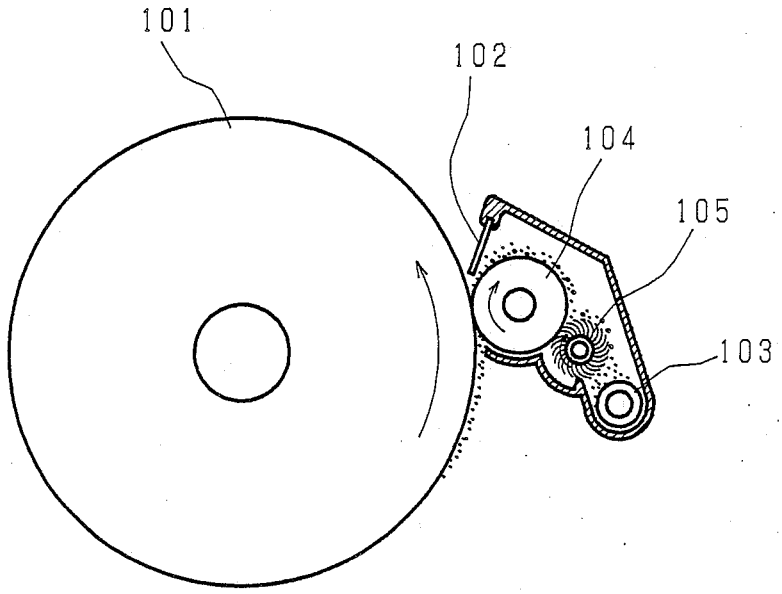
Fig. 1 Prior Art
FIG. 1 is a schematic sectional view showing a construction of a conventional residual toner cleaning device.

The following is an explanation referring to the drawings on the residual toner cleaning device of an image forming apparatus related to the invention (hereinafter, to be called the device of the present invention).

Figure 2:
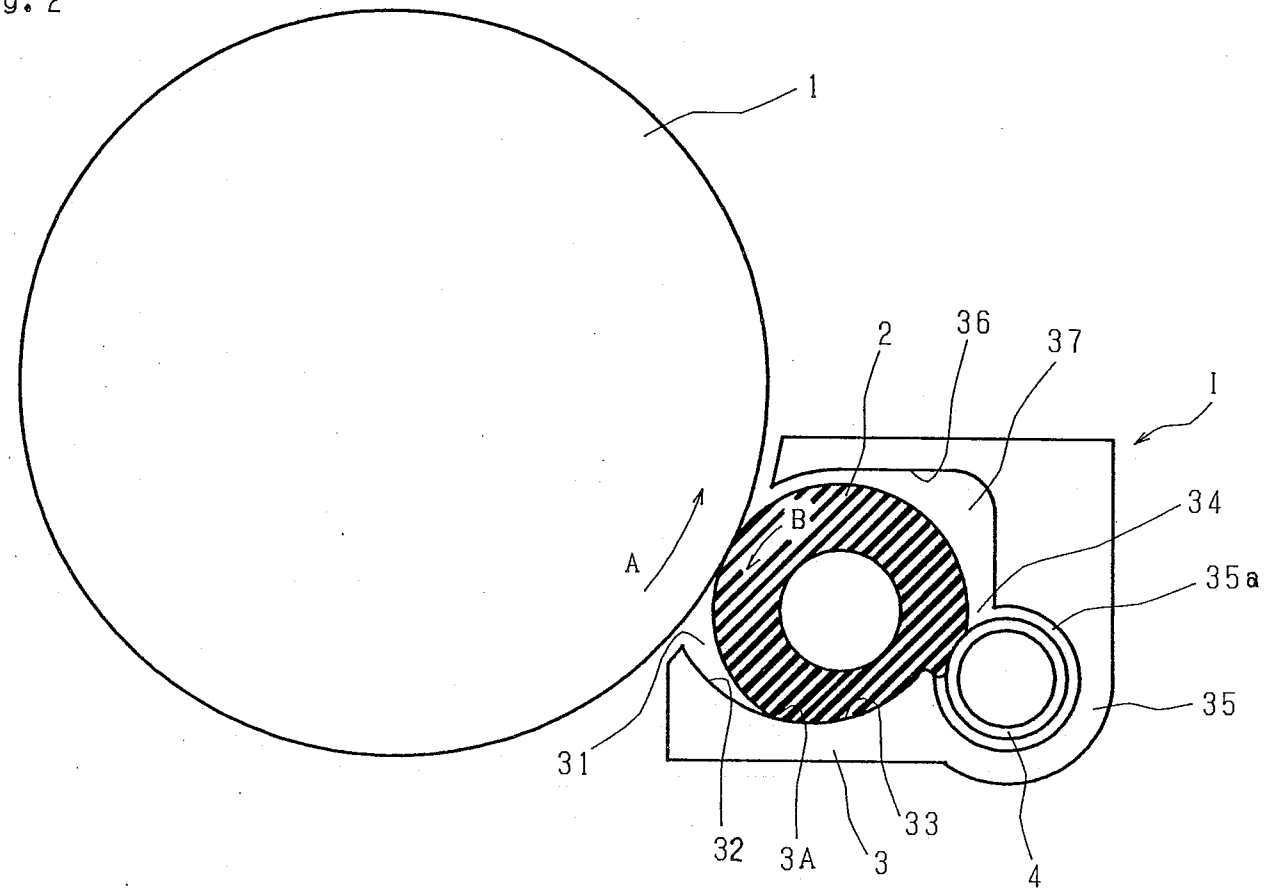
FIG. 2 is a schematic sectional view showing a construction of a residual toner cleaning device of the invention.

FIG. 2 is a schematic sectional view showing the construction of the device of the present invention (I). The device of the present invention (I) is provided adjacent to a photosensitive drum 1 rotating in the direction A indicated by an arrow in the figure, comprising of an elastic roller 2 which is provided at a position being pressed to the photosensitive drum 1 by force and is driven to rotate in the direction B indicated by an arrow in the figure, a screw conveyor 4 for collecting the toner provided at a position opposite to the photsensitive drum 1 with the elastic roller 2 therebetween, and a regulating member 3 for regulating the shape of space covering the elastic roller 2 in order to compress and restore the elastic roller 2.

The inside of the regulating member 3 which covers the lower part of the elastic roller 2 is an arc concave 3A. The arc concave 3A, on the photsensitive drum 1 side, having a gap 31 between the elastic roller 2 and itself capable of receiving the toner removed from the photsensitive drum 1 by the elastic roller 2, is so shaped to include a toner receiver 32 for receiving falling toner and a compressing portion 33 connected with the toner receiver 32 for compressing the elastic roller 2. Said compressing portion 33 is so formed to compress the elastic roller 2 harder as it approaches the edge portion relative to the rotating direction of the elastic roller 2. At the edge of the compressing portion 33 disposed downstream of the rotation, is provided a releasing portion 34 having a space for releasing and restoring the elastic roller 2 from compression by the compressing portion 33. Below the releasing portion 34 (off to the right in the figure), a toner collecting portion 35 is provided which consists of a screw conveyor 4 and an arc gap **35*a* for housing the screw conveyor 4. The screw conveyor 4 is provided rotatably at the position where a part thereof comes in contact with the elastic roller 2 restored by the releasing portion 34**.

Between the upper inner suface 36 of the regulating member 3 and the elastic roller 2, a gap 37 with an appropriate extend is provided.

Next, an explanation on the operation of the apparatus of the invention for removing the toner follows.

Figure 3:
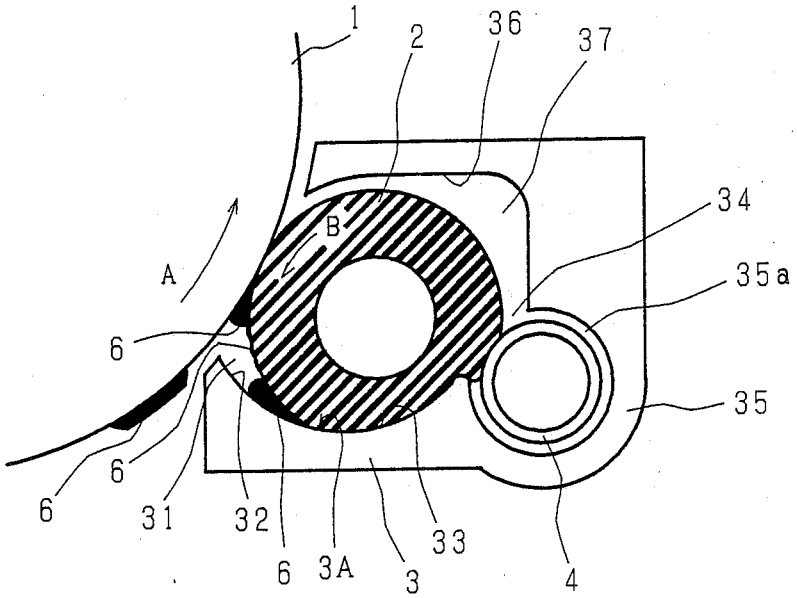
FIGS. 3, 4 and 5 are schematic diagrams for explaining a procedure for removing the residual toner by the residual toner cleaning device of the invention.
Figure 4:
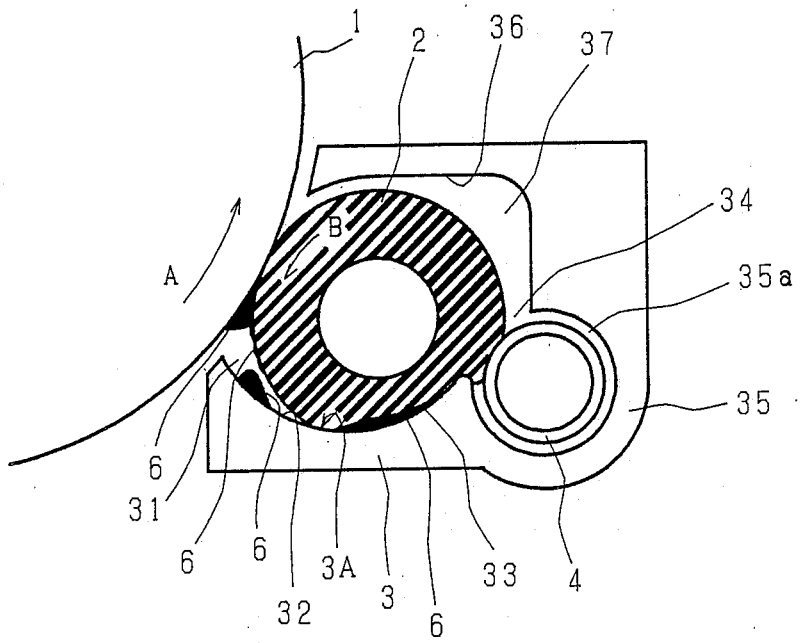
Figure 5:
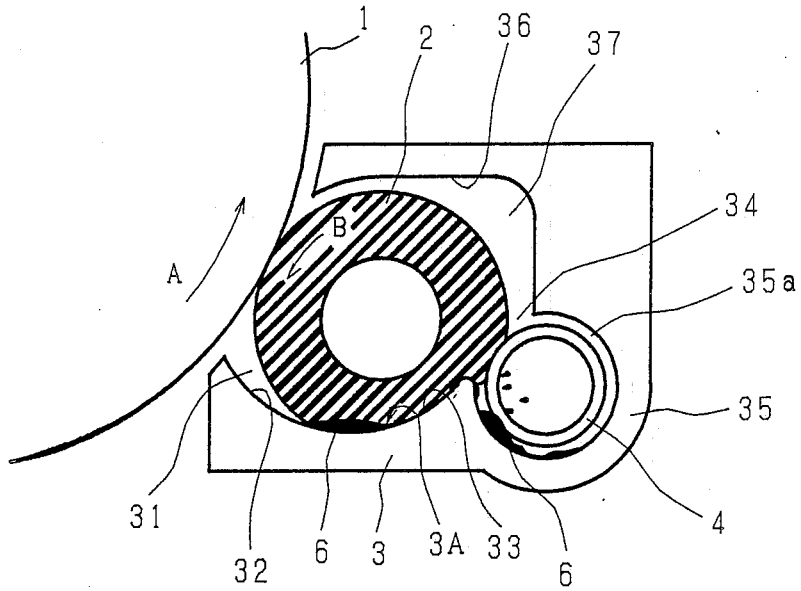

FIG. 3 is a schematic sectional view showing the state that the elastic roller 2 removes the residual toner from the photsensitive drum 1. FIG. 4 is a schematic sectional view showing the state that the elastic roller 2 transfers the toner to its rotational direction. FIG. 5 is schematic sectional view showing the state that the toner collecting portion 35 collects the toner.

The residual toner 6 on the photosensitive drum 1 is transferred by adhering to the surface of the photsensitive drum 1 rotating counterclockwise, indicated by an arrow in the figure as a direction A. When the toner 6 reaches the pressured area of the elastic roller 2 by the photsensitive drum 1, the elastic roller 2 rotating counterclockwise in the same direction as the photsensitive drum 1, indicated by an arrow in the figure as a direction B, removes the toner 6.

A part of the toner 6 removed is transferred to the direction B adhering to the surface of the elastic roller 2. The rest of the toner 6 falls into the gap 31 between the elastic roller 2 and the regulating member 3, and is accumulated at the toner receiver 32 of the arc concave 3A and advances by its gravity to the compressing portion 33 of the arc concave 3A. The toner 6 is carried out through the compressing portion 33 in the state of being put between the elastic roller 2 and the arc concave 3A as the elastic roller 2 rotates. The toner 6 carried up to the releasing portion 34 is ejected to the toner collecting portion 35 by the restoring force of the elastic roller 2 by its elasticity which has been compressed at the compressing portion 33.

On the other hand, the toner 6 carried in the direction B adhering to the elastic roller 2, is removed at the contacting point of the elastic roller 2 with the screw conveyor 4, and is transferred to the toner collecting portion 35, the screw conveyor 4 carrying the collected toner 6 outside the regulating member 3.

Still more, the material of the elastic roller 2 is of elastic body, and the types thereof are as follows; a solid type of polyurethane rubber, or of silicone rubber, or of chlorophrene rubber or the like, a foam type of polyurethane rubber, or of silicone rubber, or chloroprene rubber or the like, and a layer built type covering a surface of aforementioned solid type or foam type layer with silicone tube, or silicone rubber, or polyurethan rubber, or poly vinyl chloride, or polyester, or polyimide, or polyamide or the like.

As for the material usable for the elastic roller 2 the, following characteristics are required; capable of removing the toner from the photosensitive drum 1 and carrying it, deformable and with enough restoring force (elasticity), and not causing so much friction between the regulating member 3 and the photsensitive drum 1. For satisfying those characteristics, aforesaid foam type is the most suitable. The foam type has high utility such as being easy to lower its hardness, and to improve its ability to clean by processing its surface to be porous like a sponge. Further, in an experiment, polyurethane foam, or silicone foam or the like showed a sufficient result that the hardness thereof is 10 to 50 measured by a durometer (ASKER-C type produced by KOBUNSHI KEIKI K. K.).

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within the metes and bounds of the claims, or equivalence of such metes and bounds thereof are therefore intended to be embraced by the claims.

What is claimed is:

1. A residual toner cleaning device for removing the residual toner on a photosensitive drum of an image forming apparatus comprising:

an elastic roller in contact with said photosensitive drum and rotatable to remove said residual toner from said photosensitive drum, regulating means encompassing at least a portion of said elastic roller and having a compressing portion which compresses said elastic roller and a releasing portion for releasing said elastic roller from the compression to release the residual toner carried by said elastic roller, and toner collecting means for collecting the toner released by said elastic roller.

2. A residual toner cleaning device as set forth in claim 1, wherein said regulating means is an arc concave shaped member with a part forming said compressing portion.

3. A residual toner cleaning device as set forth in claim 2, wherein said compressing portion on said arc concave shaped member is so formed to increase compression of the elastic roller harder relative to the rotating direction of the elastic roller.

4. A residual toner cleaning device as set forth in claim 2, wherein said releasing portion is formed downstream of the edge of said arc concave shaped member.

5. A residual toner cleaning device as set forth in claim 1, wherein said elastic roller comprises an elastic material of a foam type.

6. A residual toner cleaning device as set forth in claim 1, wherein said elastic roller is porous at its surface.

7. A residual toner cleaning device as set forth in claim 1, wherein said elastic roller has a hardness of 10 to 50 measured by a durometer.

8. A residual toner cleaning device for removing the residual toner on a photosensitive drum of an image forming apparatus comprising:

an elastic roller in contact with said photosensitive drum and rotatable to remove said residual toner from said photosensitive drum, regulating means encompassing at least a portion of said elastic roller and having a compressing portion which is so formed to increase compression of the elastic roller harder relative to the rotating direction of the elastic roller and a releasing portion for releasing said elastic roller from the compression to release the residual toner carried by said elastic roller, and toner collecting means for collecting the toner released by said elastic roller.

9. A residual toner cleaning device for removing the residual toner on a photsensitive drum of an image forming apparatus comprising:

an elastic roller in contact with said photsensitive drum and rotatable to remove said residual toner from said photosensitive drum, regulating means encompassing at least a portion of said elastic roller and having an arc concave shaped member with a part forming a compressing portion which compresses said elastic roller and a releasing portion which is formed downstream of the edge of said arc concave shaped member for releasing said elastic roller from the compression to release the residual toner carried by said elastic roller, said arc concave shaped member being so formed to increase compression of the elastic roller harder relative to the rotating direction of the elastic roller, and toner collecting means for collecting the toner released by said elastic roller.

10. A residual toner cleaning device for removing the residual toner on a photsensitive drum of an image forming apparatus comprising:

an elastic roller in contact with said photosensitive drum and rotatable to remove said residual toner from said photosensitive drum, housing means covering said elastic roller and having an opening portion which is provided at a position opposite to said photsensitive drum, regulating means disposed in contact with said elastic roller in said housing means for catching the toner removed by said elastic roller, for compressing a part of said elastic roller to increase compression in the downstream of the rotating direction of said elastic roller and for releasing the toner carried by said elastic roller by means of restoring force of the elastic roller released from the compression, and toner collecting means for collecting the toner released by said elastic roller.

* * * * *

UNITED STATES PATENT AND TRADEMARK OFFICE

CERTIFICATE OF CORRECTION

PATENT NO. : 4,963,944

DATED : October 16, 1990

INVENTOR(S) : Keigo Tange

It is certified that error appears in the above-identified patent and that said Letters Patent is hereby corrected as shown below:

In col. 1, line 9, change "." (period) to --,-- (comma).

In col. 1, lines 12, 20, 25 and 56-57, change "photsensitive" (each occurrence) to --photosensitive--.

In col. 1, line 29, after "103", insert --is--.

In col. 2, lines 38-39, 45 and 48, change "photsensitive" (each occurrence) to --photosensitive--.

In col. 2, last line, change "extend" to --extent--.

In col. 3, line 8, before "schematic", insert --a--.

In col. 3, lines 11-12, 15, 16 and 54, change "photsensitive" to --photosensitive--.

UNITED STATES PATENT AND TRADEMARK OFFICE

CERTIFICATE OF CORRECTION

PATENT NO. : 4,963,944

DATED : October 16, 1990

INVENTOR(S) : Keigo Tange

It is certified that error appears in the above-identified patent and that said Letters Patent is hereby corrected as shown below:

In col. 3, line 42, change "chlorophrene" to --chloroprene--.

In col. 3, line 46, change "polyurethan" to --polyurethane--.

In col. 4, line 58 (claim 9, line 2) and line 60 (claim 9, line 4), change "photsensitive" to --photosensitive--.

In col. 5, line 10 (claim 10, line 2), change "photsensitive" to --photosensitive--.

In col. 6, line 3 (claim 10, line 9), change "photsensitive" to --photosensitive--.

Signed and Sealed this

Third Day of March, 1992

*Attest:*

HARRY F. MANBECK, JR.

*Attesting Officer*

*Commissioner of Patents and Trademarks*